US011933123B2

(12) United States Patent
Flores et al.

(10) Patent No.: US 11,933,123 B2
(45) Date of Patent: Mar. 19, 2024

(54) ANCHORING A PROGRESSIVE CAVITY PUMP IN A WELLBORE

(71) Applicant: Saudi Arabian Oil Company, Dhahran (SA)

(72) Inventors: Marcelo Ramos Flores, Udhailiyah (SA); Alaa Shawly, Jeddah (SA)

(73) Assignee: Saudi Arabian Oil Company, Dhahran (SA)

( * ) Notice: Subject to any disclaimer, the term of this patent is extended or adjusted under 35 U.S.C. 154(b) by 81 days.

(21) Appl. No.: 17/695,260

(22) Filed: Mar. 15, 2022

(65) Prior Publication Data

US 2023/0295992 A1 Sep. 21, 2023

(51) Int. Cl.

| | |
|---|---|
| ***E21B 23/01*** | (2006.01) |
| ***E21B 23/06*** | (2006.01) |
| ***E21B 33/12*** | (2006.01) |
| ***E21B 43/12*** | (2006.01) |

(52) U.S. Cl.

CPC ..... *E21B 23/01* (2013.01); *E21B 23/06* (2013.01); *E21B 33/12* (2013.01); *E21B 43/128* (2013.01)

(58) Field of Classification Search

CPC ..... E21B 23/01; E21B 23/06; E21B 33/12; E21B 43/128

See application file for complete search history.

(56) References Cited

U.S. PATENT DOCUMENTS

| | | | | |
|---|---|---|---|---|
| 4,601,343 A * | 7/1986 | Lindsey, Jr. | ..... | E21B 17/06 166/242.6 |
| 4,681,159 A * | 7/1987 | Allwin | ..... | E21B 43/10 166/124 |
| 5,017,087 A * | 5/1991 | Sneddon | ..... | F01D 15/08 415/72 |
| 5,421,780 A * | 6/1995 | Vukovic | ..... | F16D 3/04 464/147 |

(Continued)

OTHER PUBLICATIONS

Ramos et al., "Experiences and Best Practices in the use of PCP's in Orinoco Belt Carabobo Area, Venezuela," presented at The World Heavy Oil Congress, Mar. 2008, 8 pages.

(Continued)

*Primary Examiner* — Steven A MacDonald
(74) *Attorney, Agent, or Firm* — Fish & Richardson P.C.

(57) ABSTRACT

A wellbore completion assembly for anchoring a progressive cavity pump in a wellbore having a production tubing. The wellbore completion assembly includes a progressive cavity pump, an anchor, and an electrical submersible pump motor. The progressive cavity pump is configured to be disposed in a wellbore. The anchor is coupled to a downhole end of the progressive cavity pump to couple the progressive cavity pump to a production tubing positioned in the wellbore. The anchor has a body, a mechanical lock receiving assembly, and a seal. The body is coupled to the progressive cavity pump. The mechanical lock receiving assembly is positioned on a first external surface of the body to couple the body to the production tubing. The seal is positioned about (Continued)

the body to engage the production tubing. The electrical submersible pump motor is mechanically coupled to the progressive cavity pump by a drive shaft.

26 Claims, 3 Drawing Sheets

(56) References Cited

U.S. PATENT DOCUMENTS 5,595,247 A * 1/1997 Braddick ..... E21B 33/128 166/123
5,845,709 A * 12/1998 Mack ..... F04B 47/06 166/57
5,906,242 A * 5/1999 Bruewer ..... E21B 23/00 166/378
8,651,177 B2 2/2014 Vail, III et al.
10,465,517 B2 11/2019 Ladron De Guevara
2002/0153141 A1* 10/2002 Hartman ..... E21B 43/128 166/66.4
2002/0192090 A1* 12/2002 Du ..... F04D 13/062 417/423.11
2007/0051510 A1* 3/2007 Veneruso ..... C08J 7/0427 166/243
2012/0024543 A1* 2/2012 Head ..... E21B 17/10 166/77.51
2012/0132414 A1* 5/2012 Lawson ..... E21B 43/128 166/105
2012/0199367 A1* 8/2012 Bouldin ..... E21B 43/128 166/332.8
2012/0292045 A1* 11/2012 Krawiec ..... E21B 33/12 166/101
2013/0098632 A1* 4/2013 Wetzel ..... E21B 43/128 166/85.1
2013/0319694 A1* 12/2013 Lacusta ..... E21B 34/14 166/334.1
2014/0166313 A1* 6/2014 Moore ..... E21B 23/01 166/382
2018/0252081 A1* 9/2018 Roth ..... E21B 43/129

OTHER PUBLICATIONS

Ramos et al., "Producing Extra-Heavy Oil from the Orinoco Belt, Cerro Negro Area, Venezuela, Using Bottom-Drive Progressive Cavity Pumps," SPE Production & Operations, May 2007, 22(2):151-155, 5 pages.

* cited by examiner

ANCHORING A PROGRESSIVE CAVITY PUMP IN A WELLBORE

TECHNICAL FIELD

This disclosure relates to completing a wellbore.

BACKGROUND OF THE DISCLOSURE

In oil and gas production operations, fluids and gases containing hydrocarbons, along with water and other chemicals, flow from formations of the Earth into a wellbore drilled from a surface of the Earth to the formations beneath the surface of the Earth. The fluids and gases flow uphole from the formations through the wellbore to the surface of the Earth. A completion or completion assembly is the equipment placed in a wellbore after the wellbore has been drilled in the Earth by a drilling rig. The completion assembly is used to extract naturally occurring hydrocarbon deposits from the Earth and move the hydrocarbons and water to the surface of the Earth. Completion equipment may be placed in an open wellbore or in a cased wellbore. An open wellbore is a wellbore that is in direct contact with the earth and various subsurface formations of the Earth. A cased wellbore is a wellbore that has been sealed from the earth and various subsurface formations of the Earth. A wellbore can be fully cased or have portions that are open. Completing a wellbore is the process of disposing or placing the completion equipment within the wellbore such as production tubing, pumps, and motors. Production tubing, pumps, and motors are used to flow the fluids and gases to the surface of the Earth.

SUMMARY

A wellbore is drilled from the surface of the Earth to geologic formations of the Earth containing liquids and gases, in the form of hydrocarbons, chemicals, and water. A wellbore completion assembly can be positioned in the wellbore to flow the liquids and gases from the geologic formations to the surface. The wellbore completion assembly can include a progressive cavity pump coupled to an electrical submersible pump motor positioned in a production tubing in the wellbore. The progressive cavity pump can be coupled to the production tubing by an anchor. The present disclosure relates to anchoring a progressive cavity pump in a wellbore.

The wellbore completion assembly of the present disclosure has a progressive cavity pump, an anchor, and an electric submersible pump motor. The progressive cavity pump can be disposed in the wellbore to increase a pressure of the fluids and gases in the wellbore. The anchor is coupled to a downhole end of the progressive cavity pump. The anchor couples the progressive cavity pump to a production tubing positioned in the wellbore. The anchor has a body and a mechanical lock receiving assembly. The anchor can include a seal. The body is coupled to the progressive cavity pump. The mechanical lock receiving assembly is positioned on a first external surface of the body to couple the body to the production tubing. The seal is positioned about the body to engage the production tubing.

In one aspect, a wellbore completion assembly includes a progressive cavity pump, and anchor, and an electrical submersible pump motor. The progressive cavity pump is configured to be disposed in a wellbore. The anchor is coupled to a downhole end of the progressive cavity pump to couple the progressive cavity pump to a production tubing positioned in the wellbore. The anchor has a body, a mechanical lock receiving assembly, and a seal. The body is coupled to the progressive cavity pump. The mechanical lock receiving assembly is positioned on a first external surface of the body to couple the body to the production tubing. The seal is positioned about the body to engage the production tubing. The electrical submersible pump motor mechanically coupled to the progressive cavity pump by a drive shaft.

In some embodiments, the anchor couples to the progressive cavity pump inside the production tubing.

In some embodiments, the progressive cavity pump includes an insert bottom drive progressive cavity pump.

In some embodiments, the seal prevents a flow of fluid from the wellbore into the production tubing.

In some embodiments, the wellbore completion assembly further includes a placement tool mechanically coupled to the anchor. The placement tool actuates the mechanical lock receiving assembly to engage the production tubing.

In some embodiments, the wellbore completion assembly of further includes a packer coupled to the progressive cavity pump. The packer seals the progressive cavity pump to an internal surface of the production tubing.

In some embodiments, the wellbore completion assembly further includes a protector assembly positioned between the progressive cavity pump and the electrical submersible pump motor. The protector assembly prevents a flow of fluid from the wellbore into the electrical submersible pump motor. In some cases, the protector assembly includes seals surrounding the drive shaft. The drive the shaft is operably coupling the electrical submersible pump motor to the progressive cavity pump. A thrust bearing can be coupled to the drive shaft. The thrust bearing supports the drive shaft and prevent transmission of an axial thrust from the progressive cavity pump to the electric submersible pump motor.

In another aspect, a wellbore anchor tool couples to a pump to a production tubing. The wellbore anchor tool includes a body and a mechanical lock receiving assembly. The body couples to a downhole end of the pump. The mechanical lock receiving assembly is positioned on a first external surface of the body. The mechanical lock receiving assembly couples the body to the production tubing.

In some embodiments, the wellbore anchor tool couples the pump inside the production tubing.

In some embodiments, the pump includes an insert bottom drive progressive cavity pump.

In some embodiments, the body couples to an electric submersible pump motor.

In some embodiments, the wellbore anchor tool further includes a seal positioned about the body. The seal prevents a flow of fluid from the wellbore into the production tubing.

In some embodiments, the mechanical lock receiving assembly selectively engages and disengages the production tubing by a placement tool. In some cases, the placement tool is a coiled tubing, a slickline assembly, or a wireline assembly.

In another aspect, a method of anchoring a progressive cavity pump in a wellbore having a production tubing. The method includes coupling a placement tool to a wellbore completion assembly. The wellbore completion assembly includes a progressive cavity pump, and anchor, and an electrical submersible pump. The progressive cavity pump can be disposed in a wellbore. The anchor is coupled to a downhole end of the progressive cavity pump. The anchor is coupled to the progressive cavity pump to a production tubing positioned in the wellbore. The anchor includes a body, a mechanical lock receiving assembly, and a seal. The body is coupled to the progressive cavity pump. The mechanical lock receiving assembly is positioned on a first external surface of the body. The mechanical lock receiving assembly couples the body to the production tubing. The seal is positioned about the body to engage the production tubing. The electrical submersible pump motor is mechanically coupled to the progressive cavity pump by a drive shaft.

The method includes disposing, by the placement tool, the wellbore completion assembly in a production tubing positioned in the wellbore. The method includes positioning, by the placement tool, the wellbore completion assembly at a downhole end of the production tubing, the downhole end farther from a surface of the Earth than an uphole end. The method includes engaging, by the placement tool, the mechanical lock receiving assembly to the production tubing; and engaging, by the placement tool, the seal to the production tubing.

In some embodiments, the placement tool includes a coiled tubing assembly, a slickline assembly, or a wireline assembly.

In some embodiments, where the wellbore completion assembly further includes a packer coupled to the progressive cavity pump to seal the progressive cavity pump to an internal surface of the production tubing, the method further includes engaging the packer to an inner surface of the production tubing.

In some embodiments, the method further includes decoupling the placement tool from the mechanical lock receiving assembly of the wellbore completion assembly and removing the placement tool from the production tubing.

In some embodiments, the method further includes after removing the placement tool from the production tubing, disposing the placement tool in the production tubing. The method can further include coupling the placement tool to the mechanical lock receiving assembly of the wellbore completion assembly. The method can further include disengaging, by the placement tool, the seal from an inner surface of the production tubing. The method can further include removing, by the placement tool, the wellbore completion assembly from the downhole end of the production tubing.

Implementations of the present disclosure can realize one or more of the following advantages. Anchoring an insert bottom drive progressive cavity pump in the wellbore can increase a flow rate of viscous and abrasive fluids from the wellbore to the surface. For example, anchoring the insert bottom drive progressive cavity pump in the production tubing can increase the torque capacity and horsepower of the insert bottom drive progressive cavity pump, increasing the flow rate of the fluids. For example, electrical submersible pump motor heating the fluids can reduce the downhole fluid viscosity, increase oil-water separation, increase the natural separation of gases from the formations, and pump higher gas/oil ratio fluids. Anchoring the insert bottom drive progressive cavity pump in the wellbore can reduce electrical power consumption. For example, less electrical power is required to operate the insert bottom drive progressive cavity pump than a rod string driven progressive cavity pump. For example, less electrical power is used to overcome frictional losses of the rod string wearing against the production tubing. Anchoring the insert bottom drive progressive cavity pump in the wellbore can increase production tubing life. For example, anchoring the insert bottom drive progressive cavity pump in the production tubing can remove the need for the rod string, thus reducing wear and stress on the production tubing and increasing production tubing longevity.

Additionally, anchoring the insert bottom drive progressive cavity pump in the production tubing can increase wellbore fluid production in highly deviated and horizontal wells. For example, in some deviated and horizontal wells, rod strings can fail. Anchoring the insert bottom drive progressive cavity pump in the production tubing and improve the flow the fluids from the wellbore to the surface. Anchoring the insert bottom drive progressive cavity pump in the production tubing can reduce wellhead leaks. For example, the progressive cavity pump does not include rotating parts (rods) which pass through the wellhead which can reduce wellhead leaks. Anchoring the insert bottom drive progressive cavity pump in the production tubing can reduce surface packer maintenance. For example, the progressive cavity pump does not include rotating parts at the surface, so a surface packer may not be needed to seal the wellbore. Anchoring the insert bottom drive progressive cavity pump in the production tubing can increase volumetric efficiencies. For example, compared with the conventional progressive cavity pump, the frictional losses by the progressive cavity pump and the production tubing can be reduced, thus reducing the pump head pressure requirements and increasing volumetric efficiencies. Anchoring the insert bottom drive progressive cavity pump in the production tubing can reduce time and quantity of equipment required to produce fluids from the wellbore. For example, a slickline, wireline, coiled tubing, or flush-by unit can be used to place the progressive cavity pump into the wellbore instead of a workover rig.

Other aspects and advantages of this disclosure will be apparent from the following description made with reference to the accompanying drawings and the claims.

DETAILED DESCRIPTION

The present disclosure relates to a wellbore completion assembly, a wellbore anchor tool, and a method for anchoring a progressive cavity pump in a wellbore. The wellbore completion assembly can be installed in a wellbore drilled from the surface of the earth to geologic formations of the earth containing liquids and gases, in the form of hydrocarbons, chemicals, and water. The wellbore completion assembly can be placed in the wellbore to conduct and control the flow of the liquids and gases through the wellbore from the geologic formations to the surface of the earth. In some cases, the wellbore completion includes a production tubing which conducts the flow of the liquid and gases to the surface. The liquids and gases in the wellbore are pressurized. In some cases, a pressure of the liquids and gases in the wellbore is less than a threshold pressure. The wellbore completion assembly can be placed in the wellbore and coupled to the production tubing to pressurize the liquids and gases to flow the liquids and gases to the surface of the Earth.

The wellbore completion assembly includes a progressive cavity pump, an anchor to couple the progressive cavity pump to the production tubing, and an electrical submersible pump motor mechanically coupled to the progressive cavity pump. The progressive cavity pump pressurizes the wellbore fluids and gases and flows the wellbore fluids and gases into the production tubing from the wellbore. The anchor has a body, a mechanical lock receiving assembly, and a seal. The body is coupled to the progressive cavity pump. The mechanical lock receiving assembly is positioned on a first external surface of the body to couple the body to the production tubing. The seal is positioned about the body to engage the production tubing. The electrical submersible pump motor is mechanically coupled to the progressive cavity pump by a drive shaft.

Figure 1A:
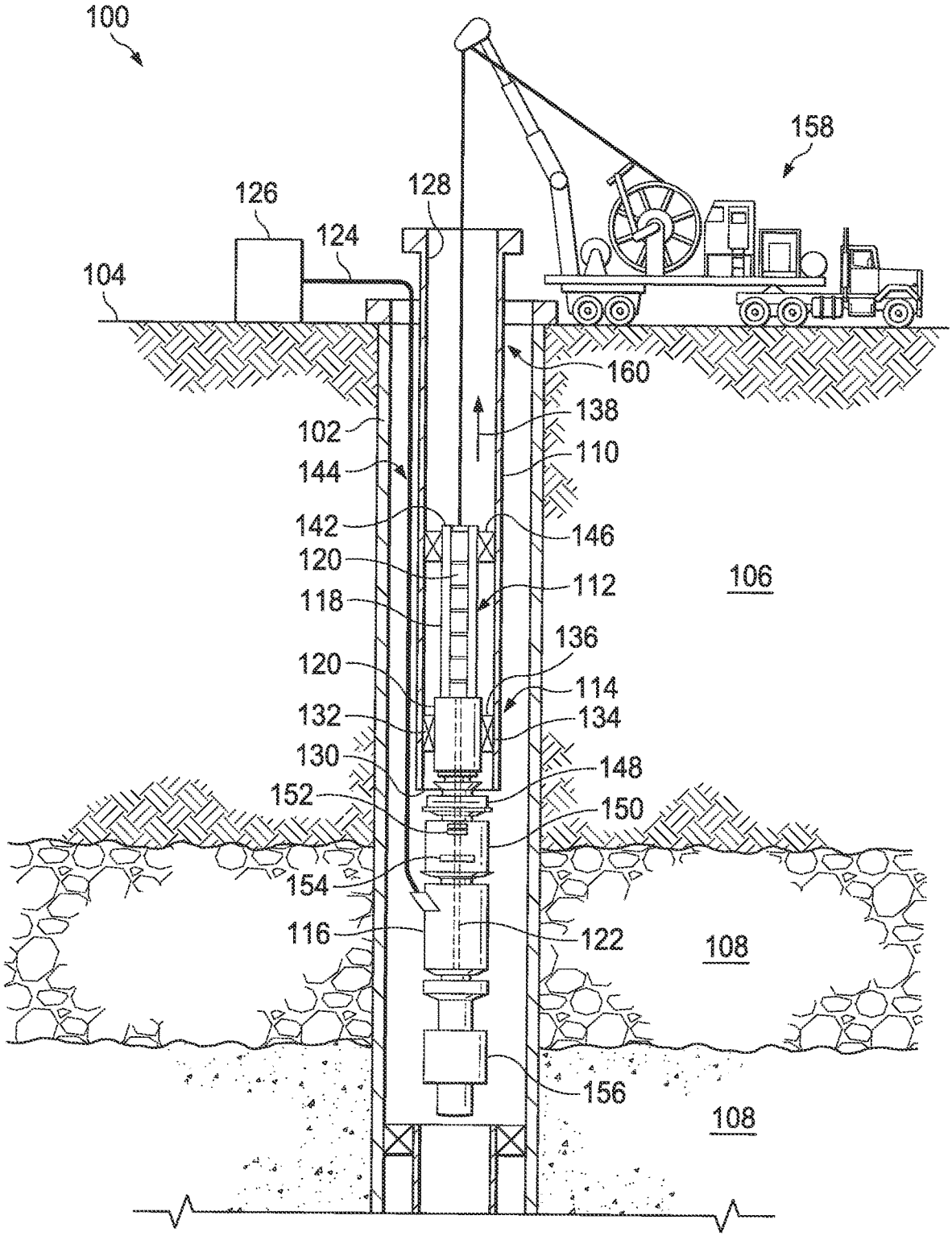
FIG. 1A is a schematic view of a wellbore completion assembly according the implementations of the present disclosure.

FIG. 1A is a schematic view of a wellbore completion assembly 100. The wellbore completion assembly 100 is shown in FIG. 1 as positioned within a wellbore 102 extending from a surface 104 of the Earth 106 down through multiple geologic formations 108 of the Earth. Some geologic formations 108 can contain hydrocarbons, water, and chemicals in the form of liquids and gases. The liquids and gases flow from the geologic formations 108 into the wellbore 102. The wellbore completion assembly 100 is positioned in the wellbore 102 to flow the liquids and gases from the wellbore 102 to the surface 104 of the Earth 106. A production tubing 110 can be placed in the wellbore 102 to conduct the liquids and gases to the surface 104.

The wellbore completion assembly 100 includes a progressive cavity pump 112, an anchor 114 to couple the progressive cavity pump 112 to the production tubing 110, and an electrical submersible pump motor 116 to drive the progressive cavity pump 112. The progressive cavity pump 112 increases the pressure of the fluid and gases so the fluids and gases flow in an uphole direction, as shown by arrow 138, through the production tubing 110 to the surface 104. The progressive cavity pump 112 has a rotor 118 and a stator 120. The rotor 118 rotates within the stator 120 to pressurize the fluid and gases. In some cases, not shown, the wellbore completion assembly 100 can include multiple sets of progressive cavity pumps 112, anchors 114, and electrical submersible pump motors 116 positioned throughout the production tubing 110. In some cases, the progressive cavity pump is an insert bottom drive progressive cavity pump.

The electrical submersible pump motor 116 is mechanically coupled to the progressive cavity pump 112 by a drive shaft 122. The electrical submersible pump motor 116 rotates the drive shaft 122 to rotate the progressive cavity pump 112. A power cable 124 is positioned in an annulus 144 defined by the wellbore 102 and the production tubing 110. The power cable 124 is coupled to a power supply 126 on the surface 104. The power supply 126 supplies electrical energy through the power cable 124 to operate the electrical submersible pump motor 116. For example, the power supply 126 can be a commercial electrical power grid or an electrical generator.

The anchor 114 couples the progressive cavity pump 112 to the production tubing 110. As shown in FIG. 1A, the anchor 114 can be positioned to couple the progressive cavity pump 112 inside the production tubing 110. That is, the anchor 114 can mechanically couple the progressive cavity pump 112 to an inner surface 128 of the production tubing 110. In some cases, the anchor 114 can mechanically couple progressive cavity pump 112 to a downhole end 130 of the production tubing 110. The production tubing 110 has an uphole end 160. The downhole end 130 is farther from the surface 104 of the Earth than the uphole end 160.

The anchor 114 has a body 132, a mechanical lock receiving assembly 134 coupled to the body 132, and a seal 136 positioned about the body 132. The body 132 of the anchor 114 is coupled to a downhole end 140 of the progressive cavity pump 112. The body 132 can be mechanically coupled to the progressive cavity pump 112 by a locking assembly 162, shown in FIG. 1B or fasteners (not shown). The body 132 can be made of a metal, for example, steel or aluminum.

Figure 1B:
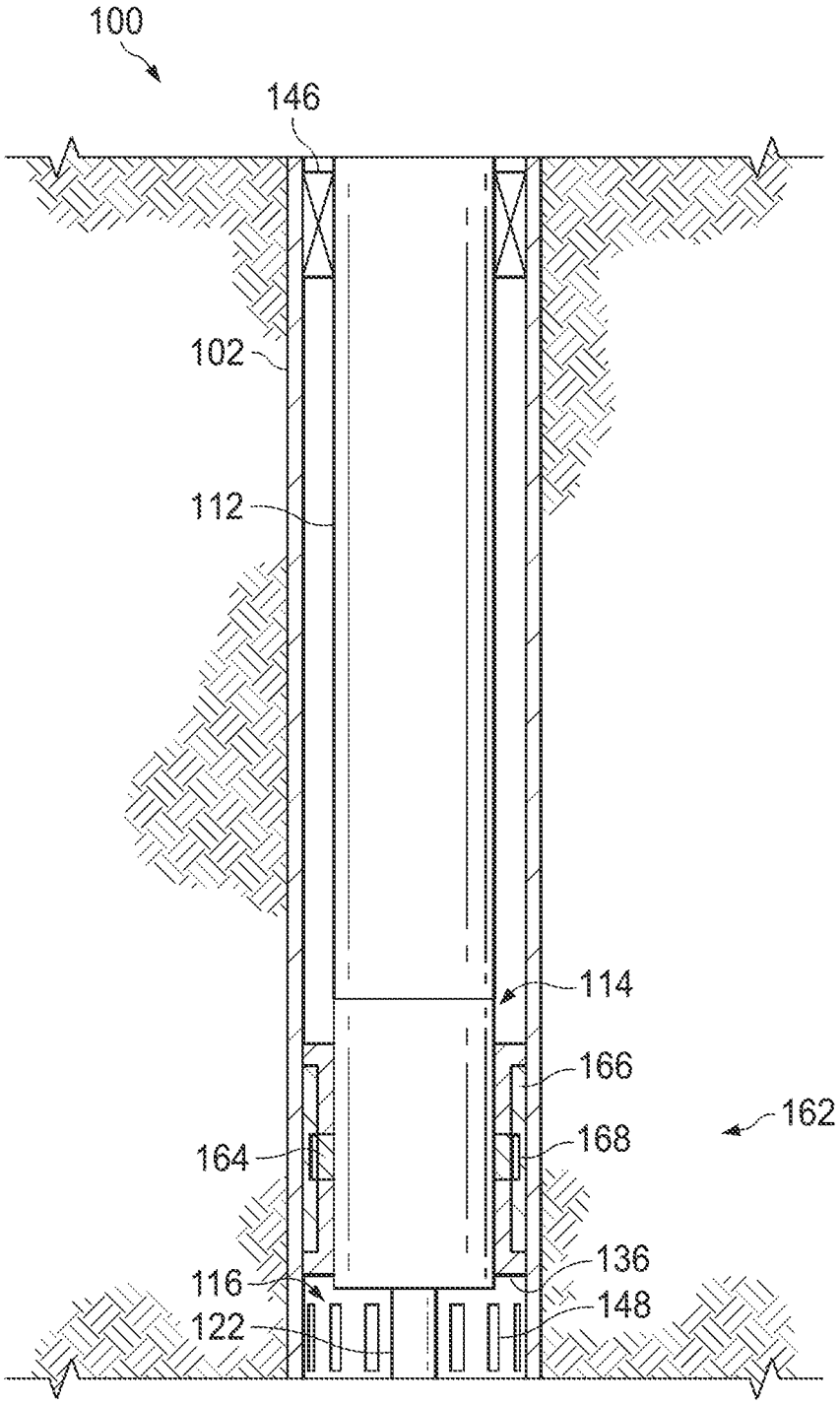
FIG. 1B is another schematic view of a wellbore completion assembly of FIG. 1A.

The mechanical lock receiving assembly 134 is mechanically coupled to the body 132 of the anchor 114. The mechanical lock receiving assembly 134 can be mechanically coupled to the body 132 by a locking assembly 162 or fasteners (not shown). The mechanical lock receiving assembly 134 mechanically engages the progressive cavity pump 112 to the production tubing 110. The mechanical lock receiving assembly 134 mechanically engages the progressive cavity pump 112 to the production tubing 110. FIG. 1B is another schematic view of a wellbore completion assembly of FIG. 1A. FIG. 1B shows the details of the locking assembly 162. Referring to FIGS. 1A and 1B, the locking assembly 162 includes one or more spring loaded retractable dogs 164. The spring loaded retractable dogs 164 engage to a nipple 166 mechanically coupled to the inner surface 128 of the production tubing 110. On installation the progressive cavity pump 112 can be jarred into the nipple 166. The spring loaded retractable dogs 164 can retract as the progressive capacity pump 112 enters the nipple 166 and snap out into a lock recess 168 when it shoulders on the nipple 166. A pull in the direction 138 verifies the progressive cavity pump 112 is correctly set.

The seal 136 is positioned about the body 132 of the anchor 114 and engage the inner surface 128 of the production tubing 110 to prevent the wellbore liquids and gases from flowing by the anchor 114 and into the production tubing 110 or to prevent the pressurized wellbore liquids and gases at an outlet 142 of the progressive cavity pump 112 from flowing back into the wellbore 102. The seal 136 can be a compressible metal seal or an elastomeric seal. In some cases, the seal 136 can include a splined shaft (not shown). The splined shaft can increase a torque capacity of the seal 136. The seal 136 can equalize wellbore 102 pressure between the downhole end 130 of the production tubing 110 and the progressive cavity pump 118. In some cases, the seal 136 can allow for the expansion of motor oil in the progressive cavity pump 118. In some cases, the seal 136 can absorb an axial or radial thrust force from the progressive cavity pump 118.

The wellbore completion assembly 100 can include a packer 146 mechanically coupled to the progressive cavity pump 112. The packer 146 can be positioned between the progressive cavity pump 112 and the inner surface 128 of the production tubing 110 to ensure that the wellbore liquids and gases pass through an intake 148 of the progressive cavity pump 112 and into the production tubing 110.

The wellbore completion assembly 100 can include a protector assembly 150 positioned about the drive shaft 122 in between the electric submersible pump motor 116 and the intake 148 of the progressive cavity pump 112. The protector assembly 150 can prevent the ingress of fluids and gases from the wellbore 102 into the electric submersible pump motor 116. The protector assembly 150 can include one or more seal 152. The seal can be a compressible metal seal or an elastomeric seal. The protector assembly 150 can include a thrust bearing 154 to support the drive shaft 122 and prevent transmission of an axial thrust from the progressive cavity pump 112 to the electric submersible pump motor 116.

The wellbore completion assembly 100 can include one or more sensors 156. Sensors 156 can sense wellbore 102 conditions and transmit signals representing wellbore 102 conditions to the surface 104. For example, wellbore 102 conditions can include a progressive cavity pump 112 intake 148 pressure, a progressive cavity pump 112 outlet 142 (discharge) pressure, progressive cavity pump 112 intake 148 temperature, a progressive cavity pump 112 outlet 142 (discharge) temperature, progressive cavity pump 112 vibration, and/or an electric submersible pump motor 116 current leakage.

The wellbore completion assembly 100 can include a placement tool 158. The placement tool 158 can mechanically couple to the anchor 114 and place the anchor 114 in the production tubing 110 between the progressive cavity pump 112 and the inner surface 128 of the production tubing 110. The placement tool 158 can selectively engage and disengage the anchor 114 to the production tubing 110. The placement tool 158 can actuate the mechanical lock receiving assembly to engage the production tubing 110. The placement tool 158 can be a coiled tubing assembly, a wireline assembly, or a slick line assembly.

In other implementations, a wellbore anchor tool 114 couples the progressive cavity pump 112 to the production tubing 110. The wellbore anchor tool 114 includes the body 132 and mechanical lock receiving assembly 134. The body 132 and mechanical lock receiving assembly 134 are described in reference to the wellbore completion assembly 100.

Figure 2:
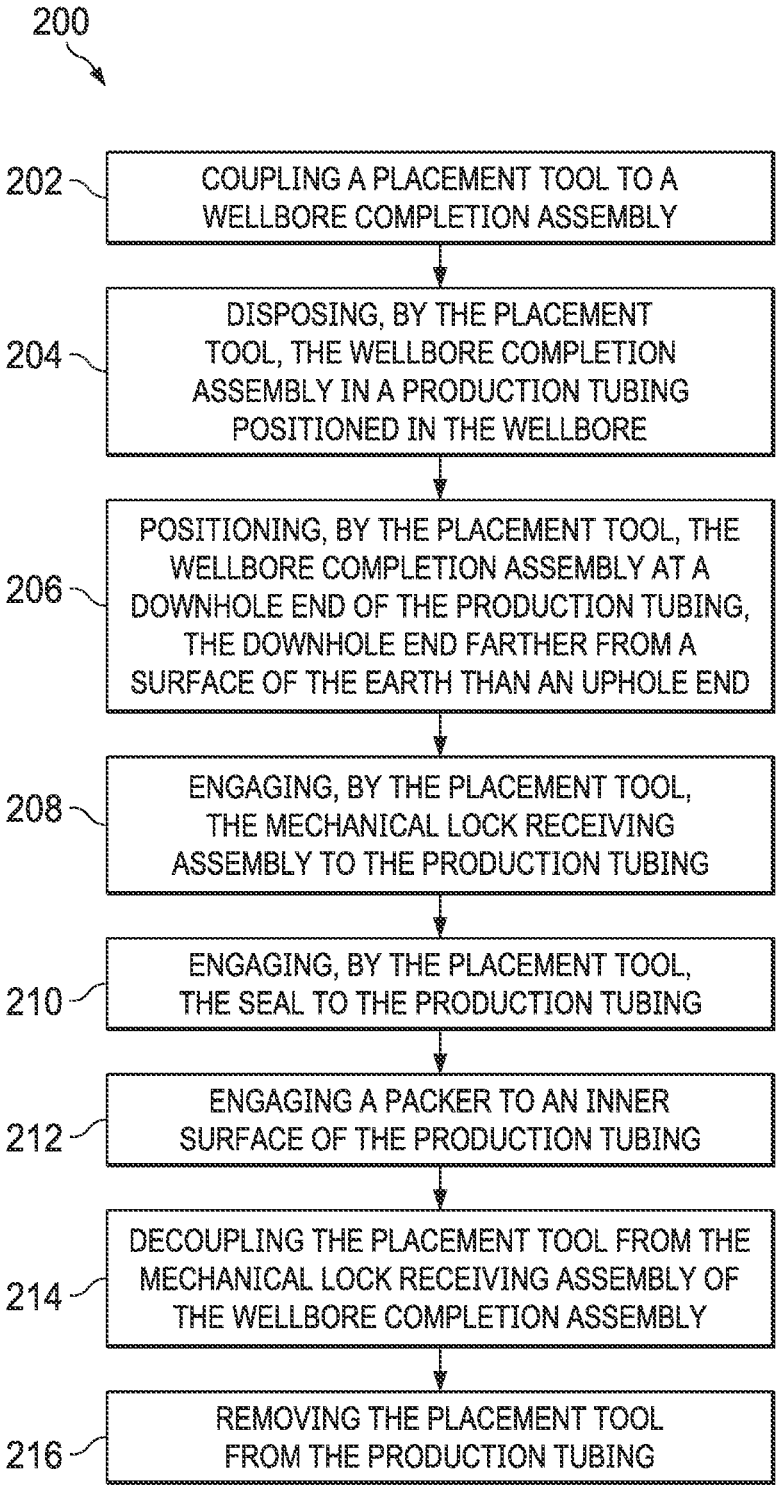
FIG. 2 is a flow chart of an example method of anchoring a progressive cavity pump in a wellbore according to the implementations of the present disclosure.

FIG. 2 is a flow chart of an example method 200 of anchoring a progressive cavity pump in a wellbore. At 202, a placement tool is coupled to a wellbore completion assembly. The wellbore completion assembly includes a progressive cavity pump, an anchor, and an electrical submersible pump. The progressive cavity pump is configured to be disposed in a wellbore. The anchor is coupled to a downhole end of the progressive cavity pump. The anchor couples the progressive cavity pump to a production tubing positioned in the wellbore. The anchor has a body, a mechanical lock receiving assembly, and a seal. The body is coupled to the progressive cavity pump. The mechanical lock receiving assembly is positioned on a first external surface of the body. The mechanical lock receiving assembly couples the body to the production tubing. The seal is positioned about the body to engage the production tubing. The electrical submersible pump motor mechanically coupled to the progressive cavity pump by a drive shaft. For example, the placement tool 158 is coupled to the mechanical lock receiving assembly 134 of the anchor 114 of the wellbore completion assembly 100.

At 204, the placement tool 158 disposes the wellbore completion assembly in a production tubing positioned in the wellbore. For example, the placement tool (wireline assembly) 158 disposed the wellbore completion assembly 100 in the wellbore 102 inside the production tubing 110.

At 206, the placement tool positions the wellbore completion assembly at a downhole end of the production tubing. The downhole end is farther from a surface of the Earth than an uphole end. For example, the placement tool (the wireline assembly) 158 places the wellbore completion assembly 100 at the downhole end 130 the production tubing 110.

At 208, the placement tool engages the mechanical lock receiving assembly to the production tubing. For example, the placement tool (the wireline assembly) 158 actuates the mechanical lock receiving assembly 134 to couple to inner surface 128 of the production tubing 110.

At 210, the placement tool engages the seal to the production tubing. For example, the placement tool (the wireline assembly) 158 can couple to the seal 136 and actuate the seal 136 to prevent the flow of fluid past the anchor 114.

At 212 a packer coupled to the progressive cavity pump to seal the progressive cavity pump to an internal surface of the production tubing is engaged to an inner surface of the production tubing. For example, the placement tool (the wireline assembly) 158 engages and actuates the packer 146 to the inner surface 128 of the production tubing 110.

At 214, the placement tool is decoupled from the mechanical lock receiving assembly of the wellbore completion assembly. For example, the placement tool (the wireline assembly) 158 is detached from the mechanical lock receiving assembly 134.

At 216, the placement tool is removed from the production tubing. For example, the placement tool (the wireline assembly) 158 is removed from the production tubing 110 and the wellbore 102 at the surface 104.

The method can include, after removing the placement tool from the production tubing, disposing the placement tool in the production tubing; coupling the placement tool to the mechanical lock receiving assembly of the wellbore completion assembly; disengaging, by the placement tool, the seal from an inner surface of the production tubing; and removing, by the placement tool, the wellbore completion assembly from the downhole end of the production tubing.

While the disclosure includes a limited number of embodiments, those skilled in the art, having benefit of this disclosure, will appreciate that other embodiments can be devised which do not depart from the scope of the present disclosure. Accordingly, the scope should be limited only by the attached claims.

The invention claimed is:

1. A wellbore completion assembly comprising:

a progressive cavity pump configured to be disposed in a wellbore;

an anchor coupled to an outer surface of the progressive cavity pump at a downhole end of the progressive cavity pump, the anchor configured to couple the progressive cavity pump to an inner surface of a production tubing positioned in the wellbore, the anchor comprising:

a body coupled to the outer surface of the progressive cavity pump;

a mechanical lock receiving assembly positioned on a first external surface of the body, the mechanical lock receiving assembly configured to couple the body to the inner surface of the production tubing; and a seal positioned about the body, the seal configured to engage the production tubing; and an electrical submersible pump motor mechanically coupled to the progressive cavity pump downhole from the electrical submersible pump motor by a drive shaft, the anchor positioned between the progressive cavity pump and the electrical submersible pump motor.

2. The wellbore completion assembly of claim 1, wherein the anchor is configured to couple to the progressive cavity pump inside the production tubing.

3. The wellbore completion assembly of claim 1, wherein the progressive cavity pump comprises an insert bottom drive progressive cavity pump.

4. The wellbore completion assembly of claim 1, wherein the seal is configured to prevent a flow of fluid from the wellbore into the production tubing.

5. The wellbore completion assembly of claim 1, further comprising a placement tool mechanically coupled to the anchor, the placement tool configured to actuate the mechanical lock receiving assembly to engage the production tubing.

6. The wellbore completion assembly of claim 1, further comprising a packer coupled to the progressive cavity pump, the packer configured to seal the progressive cavity pump to an internal surface of the production tubing.

7. The wellbore completion assembly of claim 1, further comprising a protector assembly positioned between the progressive cavity pump and the electrical submersible pump motor, the protector assembly configured to prevent a flow of fluid from the wellbore into the electrical submersible pump motor.

8. The wellbore completion assembly of claim 7, wherein the protector assembly comprises:

a plurality of seals surrounding the drive shaft, drive the shaft operably coupling the electrical submersible pump motor to the progressive cavity pump; and a thrust bearing coupled to the drive shaft, the thrust bearing configured to support the drive shaft and prevent transmission of an axial thrust from the progressive cavity pump to the electric submersible pump motor.

9. A wellbore anchor tool configured to couple a pump to a production tubing, the wellbore anchor tool comprising:

a body configured to couple to an outer surface of the pump at a downhole end of the pump; and a mechanical lock receiving assembly positioned on a first external surface of the body opposite the outer surface of the pump, the mechanical lock receiving assembly configured to couple the body to the production tubing.

10. The wellbore anchor tool of claim 9, wherein the wellbore anchor tool is configured to couple the pump inside the production tubing.

11. The wellbore anchor tool of claim 9, wherein the pump comprises an insert bottom drive progressive cavity pump.

12. The wellbore anchor tool of claim 9, wherein the body is configured to couple to an electric submersible pump motor, the electrical submersible pump motor positioned downhole from the body.

13. The wellbore anchor tool of claim 9, further comprising a seal positioned about the body, the seal configured to prevent a flow of fluid from the wellbore into the production tubing.

14. The wellbore anchor tool of claim 9, wherein the mechanical lock receiving assembly is configured to selectively engage and disengage the production tubing by a placement tool.

15. The wellbore anchor tool of claim 14, wherein the placement tool is a coiled tubing, a slickline assembly, or a wireline assembly.

16. A method of anchoring a progressive cavity pump in a wellbore comprising a production tubing, the method comprising:

coupling a placement tool to a wellbore completion assembly, the wellbore completion assembly comprising:

a progressive cavity pump configured to be disposed in a wellbore;

an anchor coupled to a downhole end of the progressive cavity pump, the anchor configured to couple the progressive cavity pump to a production tubing positioned in the wellbore, the anchor comprising:

a body coupled to the progressive cavity pump;

a mechanical lock receiving assembly positioned on a first external surface of the body, the mechanical lock receiving assembly configured to couple the body to the production tubing; and a seal positioned about the body, the seal configured to engage the production tubing; and an electrical submersible pump motor mechanically coupled to the progressive cavity pump by a drive shaft;

disposing, by the placement tool, the wellbore completion assembly in a production tubing positioned in the wellbore;

positioning, by the placement tool, the wellbore completion assembly at a downhole end of the production tubing, the downhole end farther from a surface of the Earth than an uphole end;

engaging, by the placement tool, the mechanical lock receiving assembly to the production tubing; and engaging, by the placement tool, the seal to the production tubing.

17. The method of claim 16, wherein the placement tool comprises a coiled tubing assembly, a slickline assembly, or a wireline assembly.

18. The method of claim 16, wherein the wellbore completion assembly further comprises a packer coupled to the progressive cavity pump, the packer configured to seal the progressive cavity pump to an internal surface of the production tubing, the method further comprises engaging the packer to an inner surface of the production tubing.

19. The method of claim 16, further comprising:

decoupling the placement tool from the mechanical lock receiving assembly of the wellbore completion assembly; and removing the placement tool from the production tubing.

20. The method of claim 19, further comprising:

after removing the placement tool from the production tubing, disposing the placement tool in the production tubing;

coupling the placement tool to the mechanical lock receiving assembly of the wellbore completion assembly;

disengaging, by the placement tool, the seal from an inner surface of the production tubing; and removing, by the placement tool, the wellbore completion assembly from the downhole end of the production tubing.

21. The method of claim 16, wherein the anchor is coupled to an outer surface of the progressive cavity pump at the downhole end of the progressive cavity pump.

22. The method of claim 21, wherein the body is configured to couple to the outer surface of the progressive cavity pump.

23. The method of claim 16, wherein the anchor is further configured to couple the progressive cavity pump to an inner surface of the production tubing positioned in the wellbore.

24. The method of claim 23, wherein the mechanical lock receiving assembly is configured to couple the body to the inner surface of the production tubing.

25. The method of claim 21, wherein the electrical submersible pump motor is mechanically coupled to the progressive cavity pump downhole from the electrical submersible pump motor by a drive shaft.

26. The method of claim 21, wherein the anchor is positioned between the progressive cavity pump and the electrical submersible pump motor.

* * * * *